US006242855B1

(12) United States Patent
Caronna et al.

(10) Patent No.: US 6,242,855 B1
(45) Date of Patent: Jun. 5, 2001

(54) COLOR PICTURE TUBE SHADOW MASK HAVING A COLUMN-TO-COLUMN SPACING WITH A PSEUDO-CYCLIC VARIATION

(75) Inventors: Gaetano Caronna, Colleferro; Antonino Maria Ronzani, Rome, both of (IT)

(73) Assignee: Videocolor, S.p.A., Anagni (IT)

( * ) Notice: Subject to any disclaimer, the term of this patent is extended or adjusted under 35 U.S.C. 154(b) by 0 days.

(21) Appl. No.: 09/265,787

(22) Filed: Mar. 10, 1999

(30) Foreign Application Priority Data

Mar. 20, 1998 (IT) ..... MI98A-000571

(51) Int. Cl.[7] ..... H01J 29/80

(52) U.S. Cl. ..... 313/402; 313/403; 313/408

(58) Field of Search ..... 313/402, 403, 313/407, 408, 479, 477 R; 445/37, 47, 49

(56) References Cited

U.S. PATENT DOCUMENTS

| | | | | |
|---|---|---|---|---|
| 3,766,419 | | 10/1973 | Barbin | 313/92 B |
| 3,973,159 | * | 8/1976 | Barten | 313/403 |
| 4,136,300 | | 1/1979 | Morrell | 313/403 |
| 4,186,326 | * | 1/1980 | Hosokoshi | 313/408 |
| 4,583,022 | | 4/1986 | Masterton | 313/403 |
| 4,636,683 | | 1/1987 | Tokita et al. | 313/403 |
| 4,638,212 | | 1/1987 | Nakamura | 313/408 |
| 4,691,138 | | 9/1987 | Masterton | 313/403 |
| 4,701,665 | | 10/1987 | Suzuki | 313/402 |
| 4,727,282 | | 2/1988 | Tokita et al. | 313/403 |
| 4,743,795 | * | 5/1988 | Thoms | 313/402 |
| 4,766,341 | | 8/1988 | Nakamura | 313/402 |
| 5,633,558 | * | 5/1997 | Watanabe et al. | 313/402 |

* cited by examiner

*Primary Examiner*—Ashok Patel
*Assistant Examiner*—Mariceli Santiago
(74) *Attorney, Agent, or Firm*—Joseph S. Tripoli; Dennis H. Irlbeck; Carlos M. Herrera

(57) ABSTRACT

An improved color picture tube (10) has a shadow mask (24) mounted therein in spaced relation to a viewing screen (22) thereof. The mask has a rectangular periphery with two long sides and two short sides. A major axis (X) passes through the center of the mask and parallels the long sides thereof, and a minor axis (Y) passes through the center of the mask and parallels the short sides thereof. The mask has an aperture array (35) that includes slit-shaped apertures (36) aligned in columns (37) that essentially parallel the minor axis and end at a border of the aperture array. The improvement comprises the column-to-column spacing ($a_H$) parallel to the major axis including a pseudo-cyclic variation at least in a portion of the mask, wherein a complete cycle within the pseudo-cyclic variation occurs in the column-to-column spacings between no more than nine consecutive columns.

14 Claims, 2 Drawing Sheets

COLOR PICTURE TUBE SHADOW MASK HAVING A COLUMN-TO-COLUMN SPACING WITH A PSEUDO-CYCLIC VARIATION

This invention relates to color picture tubes having shadow masks with slit-shaped apertures, wherein the apertures are aligned in columns and the apertures in each column are separated by tie bars in the mask; and, particularly, to such a tube wherein the spacing of aperture columns is varied across a mask to reduce aliasing visibility.

BACKGROUND OF THE INVENTION

A predominant number of color picture tubes in use today have line screens and shadow masks that include slit-shaped apertures. The apertures are aligned in columns, and the adjacent apertures in each column are separated from each other by webs or tie bars in the mask. Such tie bars, which define the vertical pitch ($a_V$) of the mask, are essential in the mask to maintain its integrity when it is formed into a dome-shaped contour which somewhat parallels the contour of the interior of a viewing faceplate of the tube. In earlier tubes of this type, the separations between adjacent aperture column centerlines along the major axis, or horizontal pitch ($a_H$), was held constant from center-to-edge of the mask. However, some later tubes of this type included a shadow mask with increased curvature and incorporated a shadow mask with an aperture column pitch variation as taught in U.S. Pat. No. 4,136,300, issued to A. M. Morrell on Jan. 23, 1979. In such later tubes, the pitch between centerlines of adjacent aperture columns increased from center-to-edge of the mask. This increase varied along the major axis generally as the square of the distance from the minor axis. In yet later tubes, a shadow mask aperture column-to-column pitch that varied along the major axis as the fourth power of the distance from the minor axis, such as taught in U.S. Pat. No. 4,583,022, issued to W. D. Masterton on Apr. 15, 1986, was used.

A problem that may occur during operation of color picture tubes is video aliasing. Video aliasing is an artifact, defect or distortion in a video picture usually occurring when video signals contain high frequencies. Aliasing can occur with both analog and digital video signals. With analog video, aliasing is usually caused by interference between two frequencies, such as might occur between high luminance frequencies and the horizontal spatial frequency due to the horizontal periodicity of the shadow mask of the tube. This aliasing appears as moire or herringbone patterns. With digital video, aliasing is caused by insufficient sampling or poor filtering of the digital signal, and shows up as jagged edges on diagonal lines and fluctuations in picture detail.

In video systems, aliasing will result when an image is sampled that contains frequency components above the Nyquist limit for the sampling rate. The Nyquist frequency ($f_N$) is the maximum frequency that a shadow mask can theoretically represent. The easiest solution to this aliasing problem is to increase the Nyquist frequency of the tube by decreasing the horizontal screen pitch. However, this solution has both cost and production limits. Another solution is to design an electron gun which has a larger beam spot at low current. However, a larger beam spot may degrade tube resolution to an unacceptable extent. Therefore, there is a need for solutions to the video aliasing problem which do not have these limitations.

SUMMARY OF THE INVENTION

In accordance with the present invention, an improved color picture tube has a shadow mask mounted therein in spaced relation to a viewing screen thereof. The mask has a rectangular periphery with two long sides and two short sides. A major axis passes through the center of the mask and parallels the long sides thereof, and a minor axis passes through the center of the mask and parallels the short sides thereof. The mask has an aperture array that includes slit-shaped apertures aligned in columns that essentially parallel the minor axis and end at a border of the aperture array. The improvement comprises the column-to-column spacing parallel to the major axis including a pseudo-cyclic variation at least in a portion of the mask, wherein a complete cycle within the pseudo-cyclic variation occurs in the column-to-column spacing between no more than nine consecutive columns.

DETAILED DESCRIPTION OF THE PREFERRED EMBODIMENTS

Figure 1:
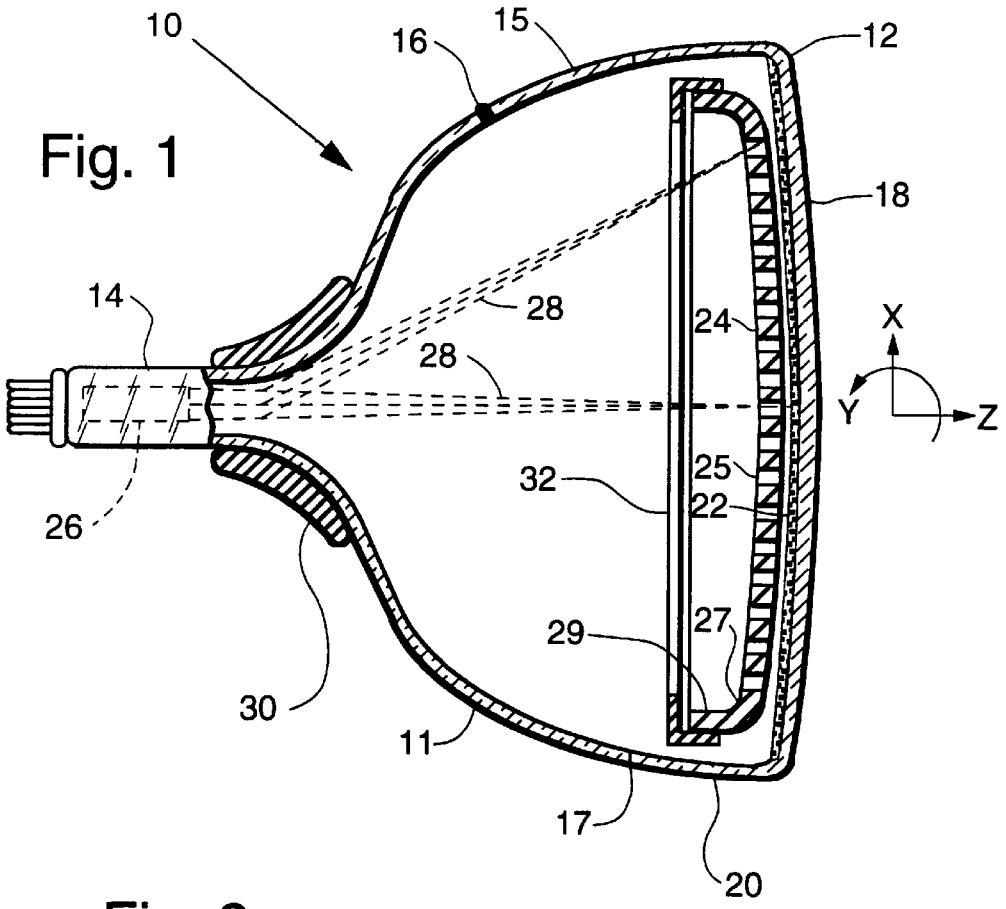
FIG. 1 is an axially sectioned side view of a color picture tube embodying the present invention.

FIG. 1 shows a rectangular color picture tube 10 having a glass envelope 11 comprising a rectangular faceplate panel 12 and a tubular neck 14 connected by a rectangular funnel 15. The funnel 15 has an internal conductive coating (not shown) that extends from an anode button 16 to the neck 14. The panel 12 comprises a viewing faceplate 18 and a peripheral flange or sidewall 20, which is sealed to the funnel 15 by a glass frit 17. A three-color phosphor screen 22 is carried by the inner surface of the faceplate 18. The screen 22 is a line screen, with the phosphor lines arranged in triads, each triad including a phosphor line of each of the three colors. A multi-apertured color selection electrode or shadow mask 24 is removably mounted, by conventional means, in predetermined spaced relation to the screen 22. An electron gun 26, shown schematically by dashed lines in FIG. 1, is centrally mounted within the neck 14 to generate and direct three electron beams 28 along convergent paths through the mask 24 to the screen 22.

The tube of FIG. 1 is designed to be used with an external magnetic deflection yoke, such as the yoke 30 shown in the neighborhood of the funnel-to-neck junction. When activated, the yoke 30 subjects the three beams 28 to magnetic fields which cause the beams to scan horizontally and vertically in a rectangular raster over the screen 22. The initial plane of deflection (at zero deflection) is at about the middle of the yoke 30. Because of fringe fields, the zone of deflection of the tube extends axially from the yoke 30 into the region of the gun 26. For simplicity, the actual curvatures of the deflected beam paths in the deflection zone are not shown in FIG. 1.

The shadow mask 24 is part of a mask-frame assembly 32 that also includes a peripheral frame 34. The mask-frame assembly 32 is shown positioned within the faceplate panel 12 in FIG. 1, and in front view in FIG. 2. The shadow mask 24 includes a curved apertured portion 25, an imperforate edge portion 27 surrounding the apertured portion 25, and a skirt portion 29 bent back from the edge portion 27 and extending away from the screen 22. The mask 24 is telescoped within the frame 34, and the skirt portion 29 is welded to the frame 34.

Figure 2:
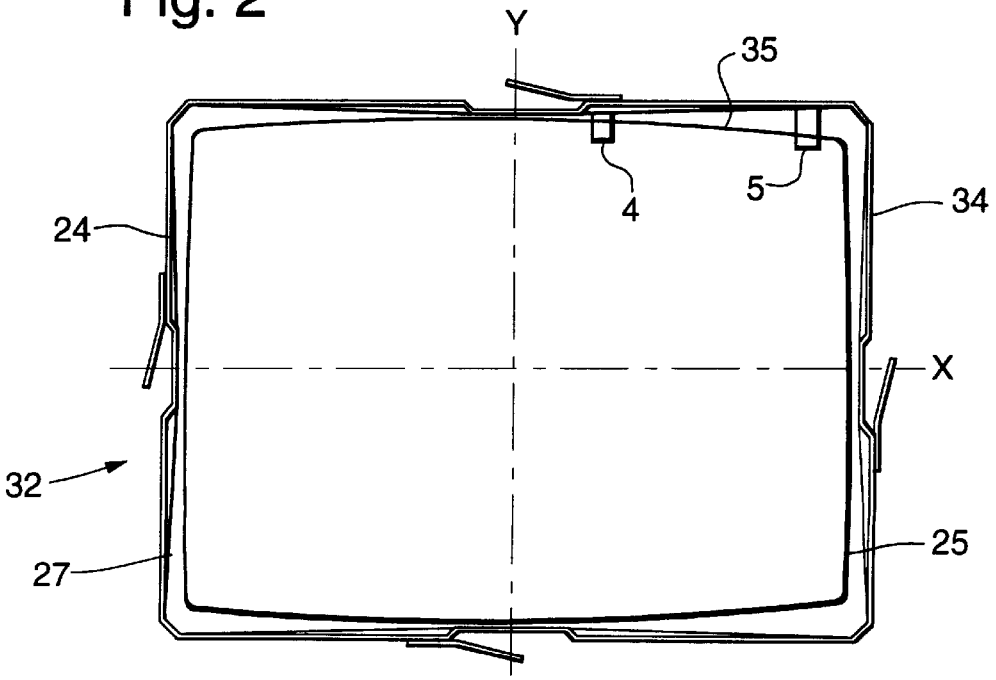
FIG. 2 is front plan view of a mask-frame assembly of the tube of FIG. 1.
Figure 3:
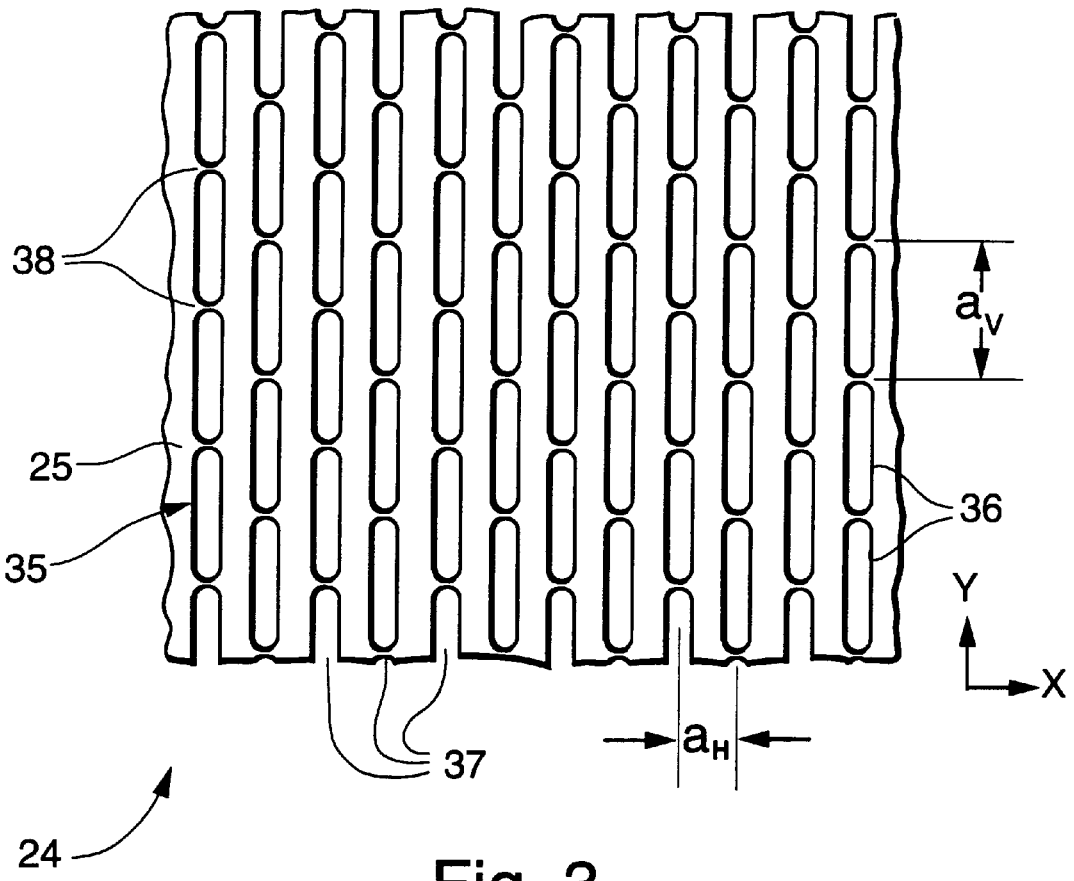
FIG. 3 is an enlarged view of a small portion of a shadow mask of the tube of FIG. 1.

As shown in FIG. 2, the mask 24 has a major axis X, which passes through the center of the mask and parallels the long sides thereof, and a minor axis Y, which passes through the center of the mask and parallels the short sides thereof. As shown in FIG. 3, the mask 24 includes an aperture array 35 of slit-shaped apertures 36 aligned in columns 37 that essentially parallel the minor axis Y. Adjacent apertures 36 in each column are separated by tie bars 38 in the mask, with the spacing between centers of adjacent tie bars 38 in a column being defined as the tie bar pitch or vertical pitch $a_V$ at a particular location on the mask.

In a preferred embodiment, the column-to-column spacing parallel to the major axis X, or horizontal pitch $a_H$, includes a "pseudo-cyclic variation" from the center of the mask to each of the two short sides of the mask. A pseudo-cyclic variation is a variation which may deviate slightly from a true cyclic variation in a random fashion. A complete cycle includes a particular spacing pattern. In a preferred embodiment, such complete cycle within the pseudo-cyclic variation occurs in the column-to-column spacing between no more than nine consecutive columns. The following five embodiments provide examples of implementations of the present invention. In each of the embodiments, p is the average column-to-column spacing parallel to the major axis within a designated area, and x is less than 20% of p. For values of x over 20%, the screen line spacing variation would be too noticeable. In a first embodiment, the pseudo-cyclic variation of the column-to-column spacing or horizontal pitch $a_H$ follows the pattern: p, p−x, p, p+x, p, p−x, p, p+x, p etc. In a second embodiment, the pseudo-cyclic variation of the column-to-column spacing follows the pattern: p, p−x, p, p+x, p. In a fourth embodiment the pseudo-cyclic variation of the column-to-column spacing follows the pattern: p−x, p+x, p−x, p+x, p−x, p+x, etc. In a fifth embodiment, the pseudo-cyclic variation of the column-to-column spacing follows the pattern: p, p, p+x, p+x, p, p, p−x, p−x, p, p, p+x, p+x, p, p, p−x, p−x, p, p, etc. In all of the above embodiments, the pseudo-cyclic variations extend over at least a portion of the mask between the center and each of the short sides of the mask. Preferably, the pseudo-cyclic variation extends from the center to each of the short sides of the mask. The x value in the equations can be a randomly distributed variable, between two limit values, that is changed every cycle; or x may be kept constant over the entire shadow mask.

The technique of varying aperture column spacing distributes screen pixels randomly in the horizontal direction, thus spreading out the aliasing spectral energy. The spread of the aliasing spectral energy decreases the amount of aliasing artifacts that can be discernible by the human eye. It has been found that a difference of 14% in the foregoing equations yields an aliasing improvement of approximately 50%.

What is claimed is:

1. In a color picture tube having a shadow mask mounted therein in spaced relation to a viewing screen thereof, said mask having a rectangular periphery with two long sides and two short sides, a major axis thereof passing through the center of said mask and paralleling said long sides and a minor axis thereof passing through the center of said mask and paralleling said short sides, and said mask having an aperture array including slit-shaped apertures aligned in columns that essentially parallel said minor axis, the improvement comprising the column-to-column spacing parallel to said major axis including a pseudo-cyclic variation at least in a portion of said mask, wherein a complete cycle within said pseudo-cyclic variation occurs in the column-to-column spacing between no more than nine consecutive columns.

2. The tube as defined in claim 1, wherein the pseudo-cyclic variation of said column-to-column spacing follows the pattern: p, p−x, p, p+x, p, p−x, p, p+x, p etc., where p is the average column-to-column spacing parallel to the major axis within a designated area, and x is less than 20% of p.

3. The tube as defined in claim 2, wherein x is a random distributed variable, between two limit values, that changes every cycle.

4. The tube as defined in claim 2, wherein x remains constant over the entire shadow mask.

5. The tube as defined in claim 1, wherein the pseudo-cyclic variation of said column-to-column spacing follows the pattern: p, p−x, p, p+x, p, where p is the average column-to-column spacing parallel to the major axis within a designated area, and x is less than 20% of p.

6. The tube as defined in claim 5, wherein x is a randomly distributed variable, between two limit values, that changes every cycle.

7. The tube as defined in claim 5, wherein x remains constant over the entire shadow mask.

8. The tube as defined in claim 1, wherein the pseudo-cyclic variation of said column-to-column spacing follows the pattern: p−x, p+x, p−x, p+x, p−x, p+x, etc., where p is the average column-to-column spacing parallel to the major axis within a designated area, and x is less than 20% of p.

9. The tube as defined in claim 8, wherein x is a random distributed variable, between two limit values, that changes every cycle.

10. The tube as defined in claim 8, wherein x remains constant over the entire shadow mask.

11. The tube as defined in claim 1, wherein the pseudo-cyclic variation of said column-to-column spacing follows the pattern: p, p, p+x, p+x, p, p, p−x, p−x, p, p, p+x, p+x, p, p, p−x, p−x, p, p, etc., where p is the average column-to-column spacing parallel to the major axis within a designated area, and x is less than 20% of p.

12. The tube as defined in claim 11, wherein x is a randomly distributed variable, between two limit values, that changes every cycle.

13. The tube as defined in claim 11, wherein x remains constant over the entire shadow mask.

14. In a color picture tube having a shadow mask mounted therein in spaced relation to a viewing screen thereof, said mask having a rectangular periphery with two long sides and two short sides, a major axis thereof passing through the center of said mask and paralleling said long sides and a minor axis thereof passing through the center of said mask and paralleling said short sides, and said mask having an aperture array including slit-shaped apertures aligned in columns that essentially parallel said minor axis, the improvement comprising the column-to-column spacing parallel to said major axis including a pseudo-cyclic variation from the center of said mask to each of the two short sides of said mask, wherein a complete cycle within said pseudo-cyclic variation occurs in the column-to-column spacing between no more than nine consecutive columns.

* * * * *